US008355516B2

(12) United States Patent
Steinbuss

(10) Patent No.: US 8,355,516 B2
(45) Date of Patent: Jan. 15, 2013

(54) HEARING APPARATUS WITH A SPECIAL SITUATION RECOGNITION UNIT AND METHOD FOR OPERATING A HEARING APPARATUS

(75) Inventor: Andre Steinbuss, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 461 days.

(21) Appl. No.: 12/607,124

(22) Filed: Oct. 28, 2009

(65) Prior Publication Data

US 2010/0104120 A1 Apr. 29, 2010

(30) Foreign Application Priority Data

Oct. 28, 2008 (DE) ..... 10 2008 053 458

(51) Int. Cl.
*H04R 25/00* (2006.01)

(52) U.S. Cl. ..... 381/312; 381/313; 381/314

(58) Field of Classification Search ..... 381/312, 381/313, 314
See application file for complete search history.

(56) References Cited

U.S. PATENT DOCUMENTS

| | | | | |
|---|---|---|---|---|
| 6,035,050 | A * | 3/2000 | Weinfurtner et al. | 381/313 |
| 6,910,013 | B2 | 6/2005 | Allegro et al. | |
| 2003/0059076 | A1 * | 3/2003 | Martin | 381/331 |
| 2003/0112987 | A1 * | 6/2003 | Nordqvist et al. | 381/312 |
| 2005/0129262 | A1 * | 6/2005 | Dillon et al. | 381/312 |
| 2006/0239484 | A1 | 10/2006 | Hamacher et al. | |
| 2008/0205659 | A1 * | 8/2008 | Fischer et al. | 381/23.1 |
| 2009/0022344 | A1 * | 1/2009 | Hain et al. | 381/312 |
| 2009/0268933 | A1 | 10/2009 | Baechler | |

FOREIGN PATENT DOCUMENTS

| | | | |
|---|---|---|---|
| DE | 10146886 | A1 | 4/2003 |
| DE | 102005019149 | B3 | 8/2006 |
| DE | 102007008738 | A1 | 8/2008 |
| EP | 0989775 | A1 | 3/2000 |
| EP | 1653773 | A2 | 5/2006 |
| WO | 0120965 | A2 | 3/2001 |
| WO | 2005018279 | A1 | 2/2005 |
| WO | 2008071236 | A2 | 6/2008 |

OTHER PUBLICATIONS

German Office Action dated Jul. 15, 2009.

* cited by examiner

*Primary Examiner* — Curtis Kuntz
*Assistant Examiner* — Amir Etesam
(74) *Attorney, Agent, or Firm* — Laurence A. Greenberg; Werner H. Stemer; Ralph E. Locher

(57) ABSTRACT

A hearing apparatus and particularly a hearing aid intended to be able to recognize acoustic situations more reliably includes a microphone device for picking-up a sound signal, a reception device for picking-up an electrical or electromagnetic signal and a classification device for determining an acoustic situation from the signals of the microphone device and the reception device. A signal processing device processes the signals of the microphone device and the reception device as a function of an output signal of the classification device. In particular, the signals of the microphone device and the reception device are made available separately to the classification device for recognizing the situation. Thus, the individual input signals, or the correlation thereof, can be used for recognizing the situation. A method for operating a hearing apparatus is also provided.

15 Claims, 1 Drawing Sheet

HEARING APPARATUS WITH A SPECIAL SITUATION RECOGNITION UNIT AND METHOD FOR OPERATING A HEARING APPARATUS

CROSS-REFERENCE TO RELATED APPLICATION

This application claims the priority, under 35 U.S.C. §119, of German Patent Application DE 10 2008 053 458.7, filed Oct. 28, 2008; the prior application is herewith incorporated by reference in its entirety.

BACKGROUND OF THE INVENTION

Field of the Invention

The present invention relates to a hearing apparatus with a microphone device for recording or picking-up a sound signal, a reception device for recording or picking-up an electrical or electromagnetic signal, a classification device for determining an acoustic situation from the signals of the microphone device and the reception device, and a signal processing device for processing the signals of the microphone device and the reception device as a function of an output signal of the classification device. Moreover, the present invention relates to a method for operating a corresponding hearing apparatus. In this case, a hearing apparatus is understood to be every piece of equipment which emits sound and can be worn in or on the ear or head, in particular a hearing aid, a headset, earphones and the like. Hearing aids are portable hearing apparatuses used to support the hard of hearing. In order to make concessions for numerous individual requirements, different types of hearing aids are provided, e.g. behind the ear (BTE) hearing aids, hearing aids with an external earpiece (receiver in the canal [RIC]) and in the ear (ITE) hearing aids, for example concha hearing aids or canal hearing aids (ITE, CIC) as well. The hearing aids, which are listed in an exemplary fashion, are worn on the concha or in the auditory canal. Furthermore, bone conduction hearing aids, implantable or vibrotactile hearing aids are also commercially available. In that case the damaged sense of hearing is stimulated either mechanically or electrically.

In principle, the basic components of a hearing aid are an input transducer, an amplifier and an output transducer. In general, the input transducer is a sound receiver, e.g. a microphone, and/or an electromagnetic receiver, e.g. an induction coil. The output transducer is usually constructed as an electroacoustic transducer, e.g. a miniaturized loudspeaker, or as an electromechanical transducer, e.g. a bone conduction earpiece. The amplifier is usually integrated into a signal processing unit. That basic structure is illustrated in FIG. 1 using the example of a behind the ear hearing aid. One or more microphones 2 for recording sound from the surroundings are installed in a hearing aid housing 1 to be worn behind the ear. A signal processing unit 3, likewise integrated in the hearing aid housing 1, processes the microphone signals and amplifies them. The output signal of the signal processing unit 3 is transferred to a loudspeaker or earpiece 4 which emits an acoustic signal. If necessary, the sound is transferred to the eardrum of the equipment wearer using a sound tube which is fixed in the auditory canal with an ear mold. A battery 5, likewise integrated into the hearing aid housing 1, supplies the hearing aid and in particular the signal processing unit 3 with energy.

Modern hearing aids generally include powerful directional microphones which often have an adaptive and multichannel structure. Additionally, directional microphones can be activated and deactivated by situation recognition algorithms to always offer the user the most advantageous microphone mode.

The input signal of the hearing aid is supplied to the situation recognition for classifying the acoustic surroundings. In the usual everyday application of a hearing aid where the input signal is only fed by the microphone of the hearing aid, that mode of operation works flawlessly. However, problems occur when microphone signals are superposed by additional audio signals which, for example, are fed wirelessly. In that configuration, the situation recognition unit operates by using the signal mixed together from the microphone and audio signals and adapts the microphone settings on the basis thereof. In that case, a signal with little meaning is fed to the situation recognition and as a result thereof the latter cannot properly match the microphone mode to the actual situation. In order to solve that problem to a certain extent, the microphone mode currently is often/manually fixed to "omnidirectional" from "automatic" as a roundabout solution.

European Patent Application EP 1 653 773 A2 discloses a method for operating a hearing aid. The hearing aid has a number of input sources such as microphone, telephone coil and the like. In addition, the hearing aid has a selection unit, a signal processing unit and a classification unit. One or more active sources are selected in the selection unit, and information connected to the selected source or sources is also processed in the classification unit.

Moreover, German Patent DE 101 46 886 B4, corresponding to U.S. Patent Application Publication No. US 2003/0059076 A1, describes a hearing aid with an automatic switchover to hearing coil operation. A control device analyzes the signals obtained by the pickups and controls or switches the transfer function between the pickups and a loudspeaker. The signals of the induction pickups are used in parallel with the signals of the microphones for switching or controlling. A classification device examines whether or not the respective induction signal and acoustic signal are useful signals.

Moreover, German Published, Non-Prosecuted Patent Application DE 10 2007 008 738 A1, corresponding to U.S. Patent Application Publication No. US 2008/0205659 A1, discloses a method for improving the spatial awareness. The input signal is analyzed, with sound sources being separated. A signal class can likewise be determined during analysis in order to correspondingly control the hearing aid. Furthermore, at least one externally fed signal is recorded by the hearing aid in addition to a microphone signal and the hearing aid is controlled correspondingly.

SUMMARY OF THE INVENTION

It is accordingly an object of the invention to provide a hearing apparatus with a special situation recognition unit and a method for operating a hearing apparatus, which overcome the hereinafore-mentioned disadvantages of the heretofore-known devices and methods of this general type and through the use of which it is possible to be able to recognize an acoustic situation more reliably if a number of different input signals are present.

With the foregoing and other objects in view there is provided, in accordance with the invention, a hearing apparatus, comprising a microphone device for picking-up or recording a sound signal, a reception device for picking-up or recording an electrical or electromagnetic signal, and a classification device for determining an acoustic situation from the signals of the microphone device and the reception device. The signals of the microphone device and the reception device are individually made available to the classification device for recognizing the situation. A signal processing device processes the signals of the microphone device and the reception device as a function of an output signal of the classification device.

With the objects of the invention in view, there is also provided a method for operating a hearing apparatus. The method comprises picking-up or recording a sound signal, picking-up or recording an electrical or electromagnetic signal, determining an acoustic situation from the picked-up or recorded signals by making the picked-up or recorded signals available separately in order to determine the acoustic situation, and processing the picked-up or recorded signals as a function of the determined acoustic situation.

Advantageously, the hearing apparatus according to the invention or the method according to the invention affords the possibility of improved recognition of acoustic situations as a function of the individual input signals. In particular, the situation recognition can be effected separately as a function of microphone signals and audio signals received electromagnetically.

In accordance with another feature of the invention, a preprocessing device is preferably connected upstream of the classification device. Through the use of the preprocessing device it can be determined which of the recorded signals is dominant on the basis of the level and through the use of the preprocessing device a corresponding control signal of the classification device can be provided. The level makes it possible to reliably recognize the dominance of an input signal, as a result of which the dominant signal can in turn be analyzed for improved recognition of the situation.

In accordance with a further feature of the invention, alternatively or additionally, a correlation of the recorded signals can be determined by the preprocessing device and therefore the preprocessing device can also provide a corresponding control signal of the classification device. The correlation of the recorded signals also supplies a clear indication with respect to the acoustic situation.

In accordance with an added feature of the invention, for the correlation analysis, a delay of the signal from the microphone device can be preconfigured in the preprocessing device in accordance with a known delay of the signal from the reception device. This affords the possibility of quickly determining a reliable result for the correlation analysis.

In accordance with an additional feature of the invention, a decision matrix can be implemented in the classification device in order to determine the output signal of the classification device on the basis of a signal obtained from the preprocessing device. This makes it possible to make a decision on the basis of the determined acoustic situation without computational expenditure.

In accordance with yet another feature of the invention, the signal processing device can additionally have a directional microphone control unit, a noise removal unit and a feedback unit, wherein of the three units only the noise removal unit and the feedback unit are adapted according to the determined acoustic situation if the signal of the reception device dominates the signal of the microphone device. Thus, if for example the audio signal received electromagnetically is dominant, it is advantageous if the microphone device is fixedly switched to omnidirectional operation so that the user remains responsive from all directions.

In accordance with yet a further feature of the invention, the classification device can use the signal of the microphone device at predetermined temporal intervals for determining the acoustic situation if the signal of the reception device is dominant. This further refines the situation recognition because it is not only the respectively dominant signal which is used for situation recognition.

In accordance with yet a concomitant feature of the invention, it can furthermore be advantageous that, if neither of the two recorded signals is dominant, the classification device uses the signal of the microphone device in order to determine the acoustic situation. This satisfies the principle that the natural acoustic surroundings are more important for recognizing the situation.

Other features which are considered as characteristic for the invention are set forth in the appended claims.

Although the invention is illustrated and described herein as embodied in a hearing apparatus with a special situation recognition unit and a method for operating a hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
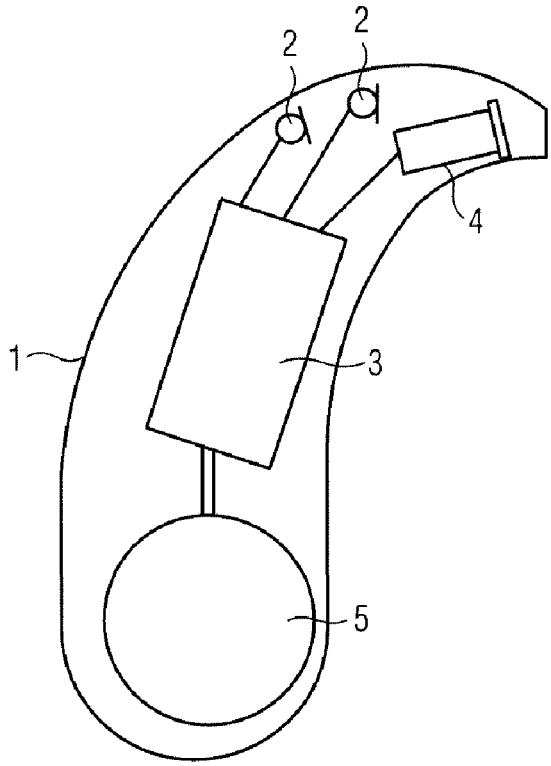
FIG. 1 Prior art
FIG. 1 is a diagrammatic, side-elevational view showing a basic structure of a hearing aid according to the prior art.
Figure 2:
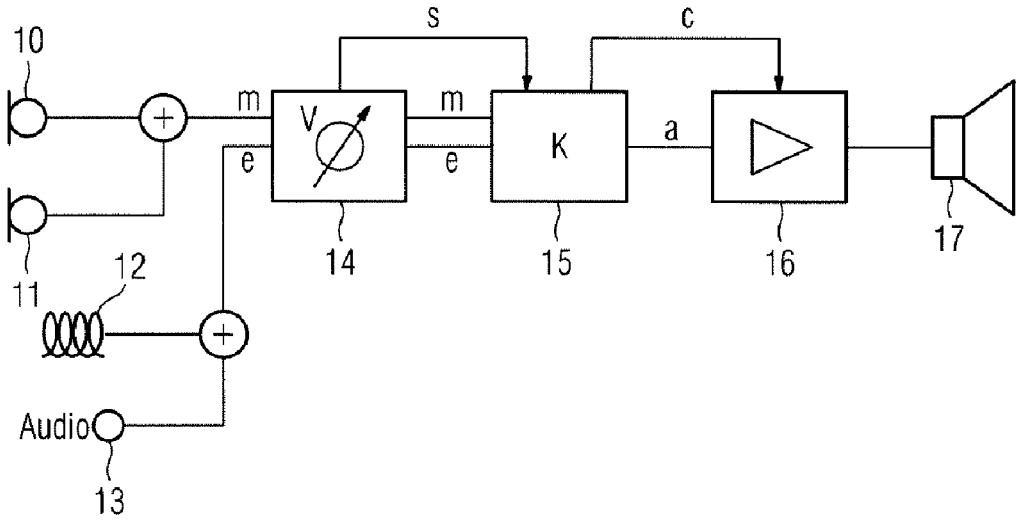
FIG. 2 is a block diagram of a hearing apparatus according to the invention.

Referring now in detail to the figures of the drawings, with which exemplary, preferred embodiments of the invention will be explained in more detail below, and first, particularly, to FIG. 2 thereof, there is seen an illustration of signal processing of a hearing aid according to the invention, in which provision is made in this case for a microphone device with two microphones 10 and 11. The signals of both microphones 10, 11 are combined and therefore result in a signal m of the microphone device. Moreover, the hearing aid, for example, includes a telephone coil 12 and an audio input 13. It goes without saying that provision can also be made for further electrical or electromagnetic inputs. In this case, these reception components 12, 13 are subsumed by the term "reception device". This reception device, that is to say the electrical and/or electromagnetic receivers, provides at least one signal e.

The microphone device signal m and the reception device signal e are fed to a preprocessing device 14. The latter has, for example, a level meter for determining which of the two signals m or e has the higher level. Alternatively, or additionally, the preprocessing device 14 can also effect a correlation analysis, through the use of which a correlation variable between the two signals m and e can be determined. The preprocessing device 14 passes on the signals m and e to a classification device 15 and feeds the latter an additional control signal s according to the level of the signals or their correlation variable. The situation recognition is conveniently carried out in the classification device on the basis of the control signal s by one of the two signals m or e being supplied to a downstream signal processing unit 16 according to a predetermined logic. The signal processing device 16 is additionally controlled or adapted on the basis of the classification result or the situation recognition, which is why the classification device 15 can supply an additional control signal c to the signal processing device 16. Finally, an output signal a of the classification device 15 is fed to an earpiece 17, amplified by the signal processing device 16.

Thus, in order to obtain an improved recognition of the situation, acoustic and electrical input signals m and e are supplied separately to the situation recognition unit (e.g. the classification device 15). During the run up there additionally is independent monitoring of the input signals m and e, for example according to criteria such as level or correlation (as mentioned). The delay of an audio signal caused, for example, by processing elements of a wireless transmission path, can advantageously be preconfigured for a correlation analysis.

This separate analysis of the different input signals can make the recognition of acoustic situations more reliable. By way of example, the acoustic situation "television" can be recognized by the fact that in addition to the acoustic transmission there additionally is a wireless transmission of similar strength and the two signals are correlated to one another. Likewise, the acoustic situation "music transmission in quiet surroundings" (e.g. jogging in the woods with wireless musical entertainment), for example, can be reliably recognized by the fact that the electromagnetic input signal has a significantly higher level than the microphone signal and the two signals are uncorrelated.

The situation recognition can be configured by a decision matrix with respect to which a signal should be used for recognizing the situation. Such a decision matrix could look as follows:

| | Audio | Microphone |
|---|---|---|
| Directional microphone | | x |
| Noise | x | x |
| Sound smoothing | x | x |
| Feedback | x | x |

This decision matrix means that in the case where the audio signal is dominant, the directional microphone is not switched on but there is adaptation with respect to noise, sound smoothing and feedback. By contrast, if the microphone signal is dominant, the directional microphone is also additionally switched on.

The decision matrix can be in the form of software configured, for example, by an audiologist. Alternatively, the decision matrix can also be fixedly prescribed.

Thus, in the case where the microphone signal is dominant and the hearing aid wearer only uses the audio signal in an accompanying fashion, the situation is preferably recognized only by the microphone signal. By contrast, if the audio signal is dominant, the situation recognition unit operates only on the basis of the audio signal. In accordance with the example above, although the noise removal and the feedback unit are adapted, the microphone is set to omnidirectional operation to ensure the responsiveness of the user in all directions. As an alternative to the fixed setting in the omnidirectional operation, the microphone can be adjusted on the basis of the independently provided microphone signal if the audio signal is dominant. By way of example, the microphone signal is briefly supplied to the situation recognition to this end and the surroundings are classified at relatively infrequent temporal intervals. After a decision, the classification unit continues to operate with the dominant audio signal.

If the levels of the two signals m and e of the microphone device 10, 11 and the reception device 12, 13 are approximately equal and there additionally is a high correlation of the two signals, it is advantageous if the situation is recognized primarily on the basis of the microphone signal.

The advantage of the described exemplary embodiment for the hearing aid wearer can be seen to be that the situation is recognized by using a "clean" signal which is free of superposition effects. Furthermore, the correlation of a number of signals can contribute to recognizing the situation. Thus, the situation recognition becomes significantly more reliable.

In addition, it is advantageous for the hearing aid wearer that, in the case of dominant audio signals, the directional microphone is not adapted on the basis of the audio signal but on the basis of the microphone which characterizes the actual acoustic situation.

The invention claimed is:

1. A hearing apparatus, comprising:

a microphone device for picking-up a sound signal;

a reception device for picking-up an electrical or electromagnetic signal;

a classification device for determining an acoustic situation from the signals of said microphone device and said reception device, the signals of said microphone device and said reception device being individually made available to said classification device for recognizing the situation;

a signal processing device for processing the signals of said microphone device and said reception device as a function of an output signal of said classification device; and a preprocessing device connected upstream of said classification device, said preprocessing device configured for determining which of the picked-up signals is dominant based on level, and said preprocessing device configured for providing a corresponding control signal of said classification device;

wherein said classification device is configured in at least one manner selected from the group consisting of:

said classification device is configured to use the signal of said microphone device at predetermined temporal intervals for determining the acoustic situation if the signal of said reception device is dominant, and said classification device uses the signal of said microphone device in order to determine the acoustic situation, if neither of the two picked-up signals is dominant.

2. The hearing apparatus according to claim 1, which further comprises a preprocessing device connected upstream of said classification device, said preprocessing device configured for determining a correlation of the picked-up signals, and said preprocessing device configured for providing a corresponding control signal of said classification device.

3. The hearing apparatus according to claim 2, wherein said preprocessing device can preconfigure a delay of the signal from said microphone device in accordance with a known delay of the signal from said reception device, for a correlation analysis.

4. The hearing apparatus according to claim 1, wherein said classification device implements a decision matrix in order to determine the output signal of said classification device based on the signal obtained from said preprocessing device.

5. The hearing apparatus according to claim 2, wherein said classification device implements a decision matrix in order to determine the output signal of said classification device based on the signal obtained from said preprocessing device.

6. The hearing apparatus according to claim 3, wherein said classification device implements a decision matrix in order to determine the output signal of said classification device based on the signal obtained from said preprocessing device.

7. The hearing apparatus according to claim 1, wherein said signal processing device has a directional microphone control unit, a noise removal unit and a feedback unit, and of said directional microphone control unit, said noise removal unit and said feedback unit, only said noise removal unit and said feedback unit are adapted according to the determined acoustic situation if the signal of said reception device dominates the signal of said microphone device.

8. The hearing apparatus according to claim 2, wherein said classification device uses the signal of said microphone device at predetermined temporal intervals for determining the acoustic situation if the signal of said reception device is dominant.

9. The hearing apparatus according to claim 3, wherein said classification device uses the signal of said microphone device at predetermined temporal intervals for determining the acoustic situation if the signal of said reception device is dominant.

10. The hearing apparatus according to claim 4, wherein said classification device uses the signal of said microphone device at predetermined temporal intervals for determining the acoustic situation if the signal of said reception device is dominant.

11. The hearing apparatus according to claim 7, wherein said classification device uses the signal of said microphone device at predetermined temporal intervals for determining the acoustic situation if the signal of said reception device is dominant.

12. The hearing apparatus according to claim 2, wherein said classification device uses the signal of said microphone device in order to determine the acoustic situation, if neither of the two picked-up signals is dominant.

13. The hearing apparatus according to claim 3, wherein said classification device uses the signal of said microphone device in order to determine the acoustic situation, if neither of the two picked-up signals is dominant.

14. The hearing apparatus according to claim 4, wherein said classification device uses the signal of said microphone device in order to determine the acoustic situation, if neither of the two picked-up signals is dominant.

15. The hearing apparatus according to claim 1, wherein said classification device is configured to determine the acoustic situation as a function of the sound signal from the microphone device and as a function of the audio signal from the reception device.

* * * * *